US005909821A

United States Patent [19]

Guridi

[11] Patent Number: 5,909,821

[45] Date of Patent: Jun. 8, 1999

[54] BEVERAGE CONTAINER INSULATOR APPARATUS

[75] Inventor: Jose Javier Silva Guridi, Houston, Tex.

[73] Assignee: Free-Zee, Inc., Houston, Tex.

[21] Appl. No.: 08/963,670

[22] Filed: Nov. 3, 1997

[51] Int. Cl.[6] ..... B65D 81/00

[52] U.S. Cl. ..... 220/739; 220/592; 220/903

[58] Field of Search ..... 220/739, 903, 220/592

[56] References Cited

U.S. PATENT DOCUMENTS

| | | | |
|---|---|---|---|
| 3,355,046 | 11/1967 | Jolly | 220/903 X |
| 4,194,627 | 3/1980 | Christensen | 220/903 X |
| 4,372,453 | 2/1983 | Branscum | 220/903 X |
| 4,892,215 | 1/1990 | Carlson et al. | 220/903 X |
| 4,921,117 | 5/1990 | Mucciarone | 220/903 X |
| 5,261,554 | 11/1993 | Forbes | 220/739 X |
| 5,551,592 | 9/1996 | Barton et al. | 220/739 X |

*Primary Examiner*—Steven Pollard
*Attorney, Agent, or Firm*—Harrison & Egbert

[57] ABSTRACT

A beverage container insulator apparatus having a base member, a receptacle member with a generally tubular interior, and a foam member extending around an exterior surface of the receptacle member. A sleeve extends around an exterior of the foam member. The sleeve is formed of a transparent material. The base member has a generally flat surface forming a base of the insulator apparatus and an upwardly extending inner ring member having a connector thereon for receiving the receptacle member. A plurality of clip members extend resiliently into the tubular interior for releasably retaining the beverage container therein.

16 Claims, 5 Drawing Sheets

BEVERAGE CONTAINER INSULATOR APPARATUS

TECHNICAL FIELD

The present invention relates generally to beverage container holders. More particularly, the present invention relates to container insulators which will firmly grip the container, but are releasable so as to allow easy insertion and removal of the container.

BACKGROUND ART

Various types of container holders have long been popular for glasses and cans, particularly where the object being held is a cold drink. Oftentimes, these "coaster" type devices are provided with some type of insulation so as to help keep the container being held cool. Another advantage of using this type of device is that the person drinking from the container does not have to touch the container which, because of the warm air striking the cool container, will cause moisture to condense and run down the sides.

An additional problem with conventional koozies is that they are very difficult to imprint with advertising information. It is often quite difficult to make the printing apparatus which can print along the surface of a cylindrical container. In any event, even when such a printing device is developed, it cannot easily process large numbers of holders simply because of the shape of the holder. The tubular configuration of the beverage can holder also has a relatively high manufacturing expense since the closed tubular shape must be molded with the foam material.

It is a common problem with conventional beverage can holder designs that it is quite difficult to remove the can from the interior of the holder. Often, the interior cavity of the holder fits flush against the outer surface of the can. A vacuum or friction is created between the surface of the holder and the surface of the can. This makes release of the can very difficult. It is usually necessary to squeeze the holder or to bend the can so as to create a proper release of the can from the holder.

In the past, various U.S. patents have issued on various types of beverage can holders. U.S. Pat. No. 2,201,779, issued on May 21, 1940, to H. Lathrop describes an ornamental covering for containers. This ornamental covering has a cover element which is detachably secured, by a snap, around the exterior surface of the container. A covering element, formed like a hat, is designed so as to extend around the cylindrical diameter of the body covering. A top surface extends over the top of the container. The body covering is connected in overlapping relationship by the use of the snaps.

U.S. Pat. No. 4,372,453, issued on Feb. 8, 1983, to T. E. Branscum describes a container holder that includes a cylindrical support for receiving the container. The cylindrical support is made of an insulating material, such as rigid foam. The top of the support is provided with an opening which is eccentric relative to the center of the support. A pivotal cap is received on the support and has an opening which overlies the first opening. When the openings are aligned, a container may be inserted into the support. The openings are large enough to accommodate beverage cans or other containers of different sizes. After the container is inserted, the cap is pivoted so as to cause the container to be gripped between the edges of the opening at the top of the support and the edges of the opening in the pivotal cap.

U.S. Pat. No. 4,383,422, issued on May 17, 1983, to Gordon et al. teaches an insulated holder for a beverage that has a ring around the edge of the can and a vacuum release. A flexible member sealingly engages the side walls of the beverage container at the other end of the compartment so as to form an airtight, sealed space within the compartment and to provide effective insulation to the beverage container. A valve is provided on the holder wall so as to permit the easy insertion and removal of a beverage container from the holder compartment.

U.S. Pat. No. 4,681,239, issued on Jul. 21, 1987, to Manns et al. describes an insulated container for cans that has a ring at the top so as to keep the can from touching the sides. An airspace is formed between the insulation material and the sides of the can. An annular sealing member of resilient cellular material has a radial dimension which is substantially greater than the radial dimension of the annular recess.

U.S. Pat. No. 4,720,023, issued on Jan. 19, 1988, to M. J. Jeff describes a combined insulated mug and beverage can holder that includes a one-piece flexible ring-shaped retainer with an annular groove that mounts on the upper rim of an insulated mug. The annular groove on the retainer has an outside lip that has a slightly inward bias and is of a slightly smaller diameter than the outside of the flared portion of the mug that it is fastened to. When the retainer is fitted to the mug's upper rim, the insulated mug functions as an insulated holder of a beverage can and when the retainer is not fitted to the upper rim, the mug can function as a normal drinking vessel.

U.S. Pat. No. 4,872,577, issued on Oct. 10, 1989, to J. L. Smith teaches a beverage can holder having a lid which is hingedly connected to the side of the holder body. The lid has a configuration which fits over the exterior surface of the can.

U.S. Pat. No. 5,169,025, issued on Dec. 8, 1992, to I-Hong Guo describes a beverage can holder body that is capable of assembly. The body has a plurality of buttons that can be fastened together to form the body of the beverage can holder. The base of the holder is attached by fastening the snaps to the buttons on the body.

British Patent No. 2,235,523 teaches an insulation container for a beverage can which has a slot down the side. This container does not have a hole on the bottom. Information or promotional material may be placed on the outer layer of the container. A zipper is provided so as to permit inspection of the bottle and access to the container.

It is an object of the present invention to provide a beverage container insulator apparatus which allows for easy insertion and release of the beverage container.

It is another object of the present invention to provide a beverage container insulator apparatus which allows advertising and image information to be easily included on the exterior of the apparatus.

It is a further object of the present invention to provide a beverage container insulator apparatus which effectively insulates the container received within the apparatus.

It is a further object of the present invention to provide a beverage container insulator apparatus that is easy to assemble, easy to use, easy to manufacture, and easy to display.

These and other objects and advantages of the present invention will become apparent from a reading of the attached specification and appended claims.

SUMMARY OF THE INVENTION

The present invention is a beverage container insulator apparatus comprising a base member, a receptacle member having a generally tubular interior and means thereon for affixing to the base member, and a foam member extending around an exterior surface of the receptacle member. A sleeve extends around an exterior of the foam member. The sleeve is formed of a transparent material. An image member is interposed between the sleeve and the exterior of the foam member. The image member contains image information formed on a surface facing the sleeve.

In the present invention, the base member includes a flat surface forming the base of the insulator apparatus, and an upwardly extending inner ring member having a connector for attaching to the receptacle member. The upwardly extending inner ring member has a diameter generally matching an inner diameter of the tubular interior of the receptacle member. The base member also has an outer ring member extending upwardly around a periphery of the base member. The foam member is interposed between the inner ring member and the outer ring member. The inner ring member is concentric with the outer ring member. The inner and outer ring members extend upwardly transversely to the flat surface.

The connector on the inner ring member is a lip which extends around an outer surface of the inner ring member adjacent a top edge of the inner ring member. The receptacle member has a ledge which extends inwardly from a bottom of the tubular interior of the receptacle member. The lip engages the ledge so as to retain the base member on the bottom of the receptacle member.

The receptacle member includes a flat annular surface connected to the tubular interior and extending radially outwardly therefrom. The tubular interior forms a beverage container receiving volume. The flat annular surface has a downwardly extending ring member formed along an outer edge of the flat annular surface. The foam member is interposed between the downwardly extending ring member and the exterior surface of the receptacle member. The flat annular surface and the tubular interior are integrally formed of a polymeric material. The receptacle member also includes a clip means formed on the tubular interior so as to extend resiliently into the tubular interior. The clip means serves to releasably retain the beverage container therein.

DETAILED DESCRIPTION OF THE INVENTION

Figure 1:
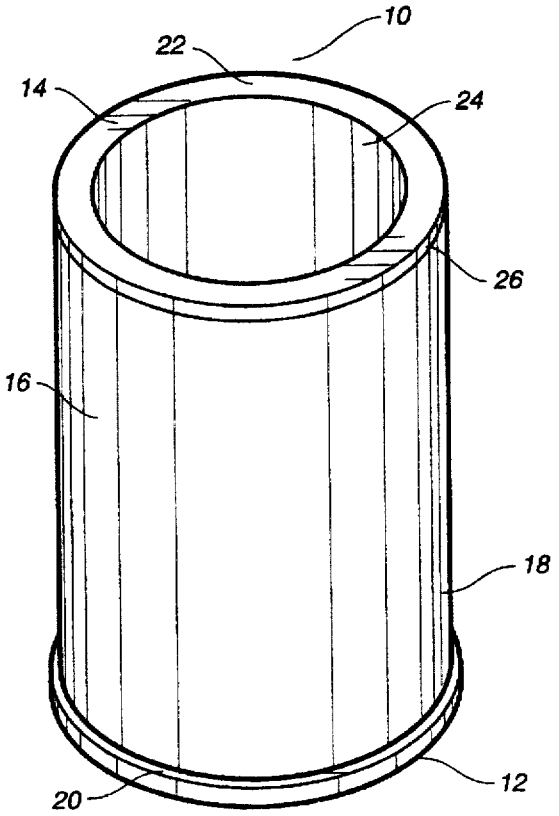
FIG. 1 is a perspective view of the beverage container insulator apparatus of the present invention.

Referring to FIG. 1, there is shown at 10 the beverage container insulator apparatus in accordance with the teachings of the present invention. The beverage container insulator apparatus 10 includes a base member 12, a receptacle member 14, a foam member 16 and a transparent sleeve 18.

The base member 12 is positioned at the bottom of the apparatus 10. The base member 12 includes an upwardly extending outer ring member 20 which serves to receive therein the sleeve 18 and the foam member 16. The receptacle member 14 includes a top flat annular surface 22 which opens to a tubular interior 24. The tubular interior 24 extends downwardly through the interior of the apparatus 10 so as to provide a beverage container receiving volume. The flat annular surface 14 has a downwardly extending ring member 26 which serves to receive the foam member 16 and the sleeve 18 therein. The sleeve 18 and the foam member 16 are interposed between the flat annular surface 22 of the receptacle member 14 and the base member 12. As will be described hereinafter, image information can be formed between the foam member 16 and the sleeve 18 so that photographs, illustrations, logos, and other information can be prominently displayed.

Figure 2:
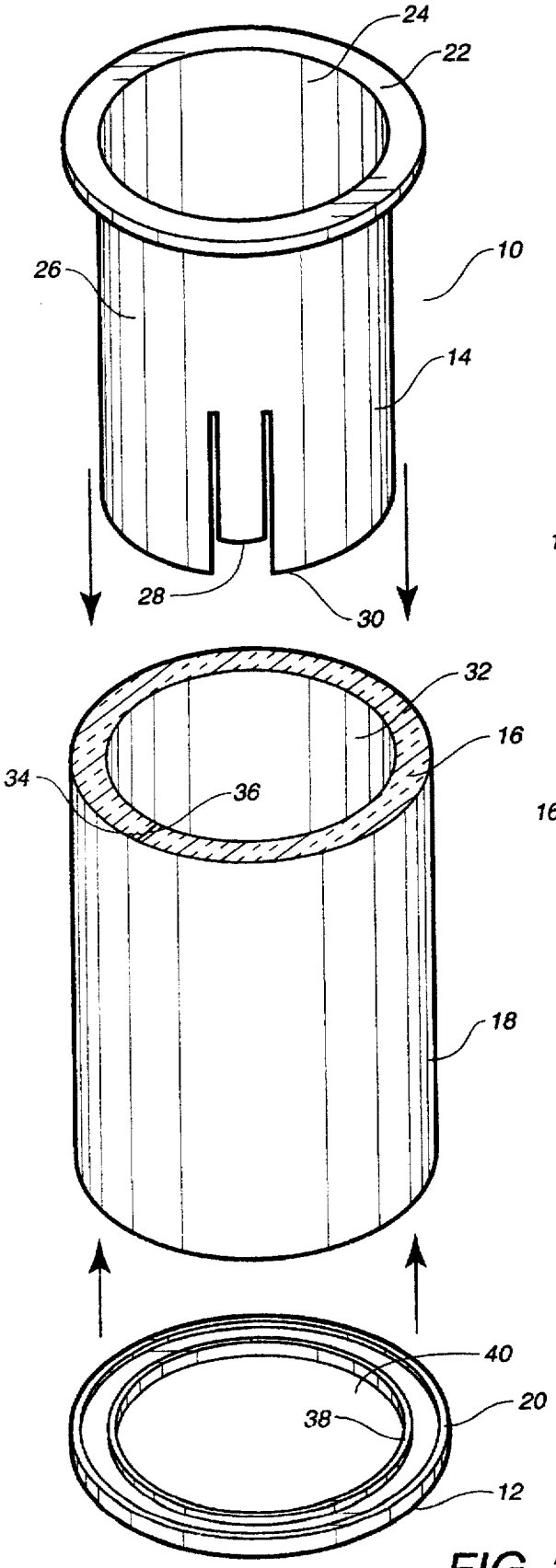
FIG. 2 is an exploded view of the beverage container insulator apparatus of the present invention.

FIG. 2 is a detailed view showing the assembly of the apparatus 10 of the present invention. Initially, it can be seen that the receptacle member 14 has its upper flat annular surface 22 formed on a top surface of a tubular interior member 26. The tubular interior member 26 and the flat annular surface 22 are integrally formed together of a polymeric material. A generally rectangular clip member 28 is formed in the tubular interior member 26 adjacent to the bottom 30 of the receptacle member 14. The clip member 28 has a generally rectangular configuration with three sides being separated from the tubular interior member 26. As will be described hereinafter, an abutment member is formed on the interior surface of the clip member 28 so as to resiliently and releasably retain a beverage container within the tubular interior 24 of the receptacle member 14.

The tubular interior member 26 is inserted into the interior 32 of the foam member 16. As can be seen, the foam member 16 is configured so as to have abutting ends 34 and 36 retained within the sleeve 18. The foam member 16 serves to insulate any beverage containers that are received within the tubular interior 24 of the receptacle member 14.

The base member 12 includes an outer ring member 20 and an inner ring member 38. A flat surface 40 extends across the bottom of the base member 12 so as to form the bottom of the apparatus 10. As will be described hereinafter, the bottom edge 30 of the receptacle member 14 is affixed to the inner ring member 38 of the base member 12. The foam member 16 and the sleeve 18 will be retained between the outer ring member 20 and the inner ring member 38 of the base member 12. The foam member 16 and the sleeve 18 will also be retained between the flat annular surface 22 of the receptacle member 14 and the base member 12.

Figure 3:
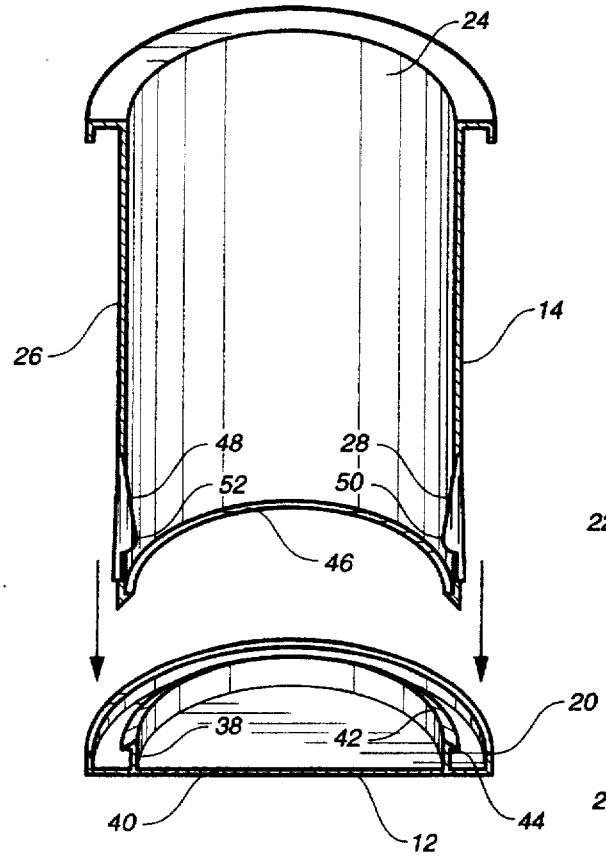
FIG. 3 is an exploded cross-sectional view of the beverage container insulator apparatus of the present invention.

FIG. 3 shows the assembly and connection of the receptacle member 14 to the base member 12. As can be seen in FIG. 3, the base member 12 has its inner ring member 38 with a lip 42 extending outwardly therearound adjacent to the top edge of the inner ring member 38. Lip 42 has a receiving surface 44 for connection to a ledge 46 formed on the tubular interior member 26 of the receptacle member 14. When the tubular interior member 26 is inserted within the foam member 16 and pressed downwardly, the ledge 46 will reside on the surface 44 of the lip 42 such that the receptacle member 14 is securely affixed to the base member 12.

In FIG. 3, it can be seen that the bottom 40 of the base member 12 extends across the entire bottom surface of the base member 12. The outer ring member 20 is formed so as to be concentric with the inner ring member 38. The space between the outer ring member 20 and the inner ring member 38 serves to receive the sleeve 18 and the foam member 16.

The receptacle member 14 includes clips 28 and 46 for the releasable retention of a beverage can within the tubular interior 24 of the receptacle member 14. As can be seen, the clips 28 and 48 have an abutment surfaces 50 and 52, respectively, formed thereon. The abutment surfaces 50 and 52 are formed so as to extend inwardly into the tubular interior 24 of the tubular interior member 26 of receptacle member 14. These abutment surfaces 50 and 52 taper so that the bottom edge of the abutment surfaces 50 and 52 extends further into the interior of the tubular interior 24 than the top edge.

Figure 4:
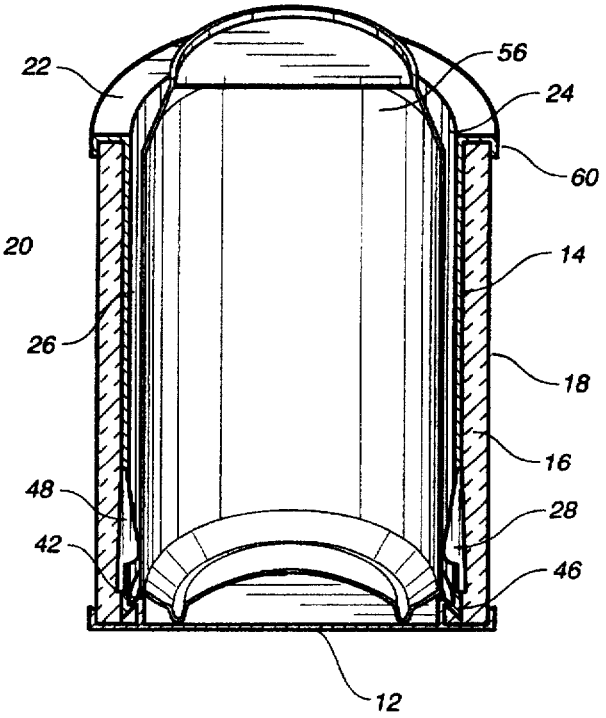
FIG. 4 is a cross-sectional assembled view of the beverage container insulator apparatus as shown as receiving a beverage container therein.

FIG. 4 shows a beverage can 56 as received within the tubular interior 24 of the receptacle member 14. The beverage container 56 slides into the tubular interior 24 until the bottom of the can contacts the bottom 40 of the base member 12. The clips 28 and 48 serve to resiliently contact the exterior surface of the beverage can 56 so as to retain the beverage can 56 within the tubular interior 24. This figure also shows the manner in which the ledge 46 of the receptacle member 14 is received by the lip 42 on the base member 12. It can further be seen that the foam member 16 and the sleeve 18 are received between the outwardly extending ring member 60 of the flat annular surface 22 and the tubular interior member 26 of the receptacle member 14. Since a space exists between the exterior of the beverage can 56 and the interior surface of the tubular interior 24, no vacuum will occur between these surfaces. As a result, it becomes relatively easy to remove the beverage can 56 from the interior. It has been found the clip members 28 and 48 exert sufficient pressure so as to retain the beverage can 56 within the tubular interior 24. The close proximity of the foam member 16 to the tubular interior member 26 assures that the beverage within the beverage can 56 is kept in a cool or hot condition.

Figure 5:
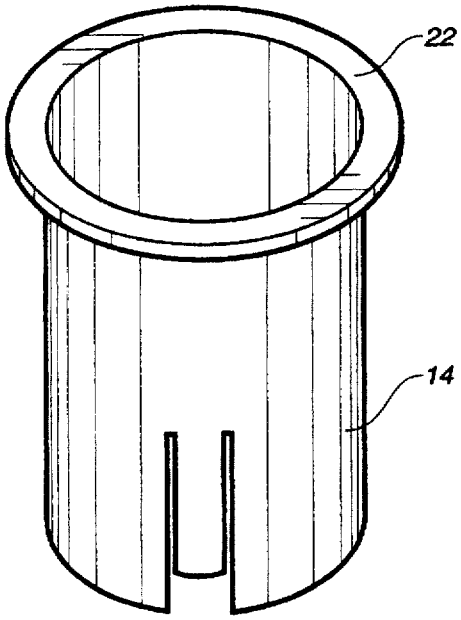
FIG. 5 is an isolated frontal perspective view of the receptacle member of the present invention.
Figure 6:
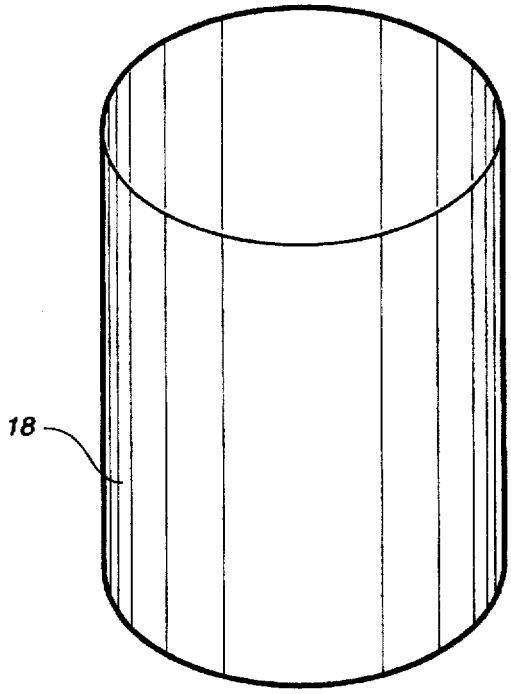
FIG. 6 is an isolated perspective view of the sleeve of the present invention.

FIG. 5 shows the receptacle member 14 with its top flat annular surface 22. FIG. 6 is an isolated view of the sleeve 18. The sleeve 18 should be of a transparent material so that any image information formed on the exterior of the foam member 16 can be prominently displayed therethrough. The sleeve member 18 is of a tubular configuration. Typically, the sleeve 18 will be formed of a clear vinyl or plastic material.

Figure 7:
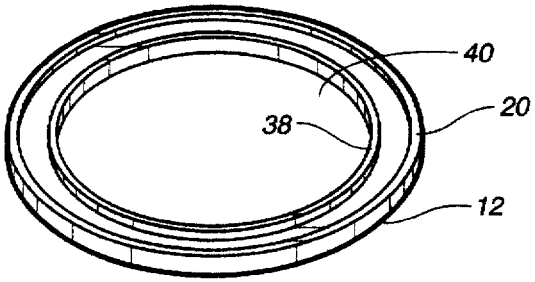
FIG. 7 is an isolated frontal perspective view of the base member of the present invention.

FIG. 7 shows the base member 12 with its inner ring 38 and its outer ring 28. The bottom 40 is a circular member which extends entirely across the bottom of the base member 12. The outer ring 20, the inner ring 38 and the bottom 40 are integrally formed together of a polymeric material.

Figure 8:
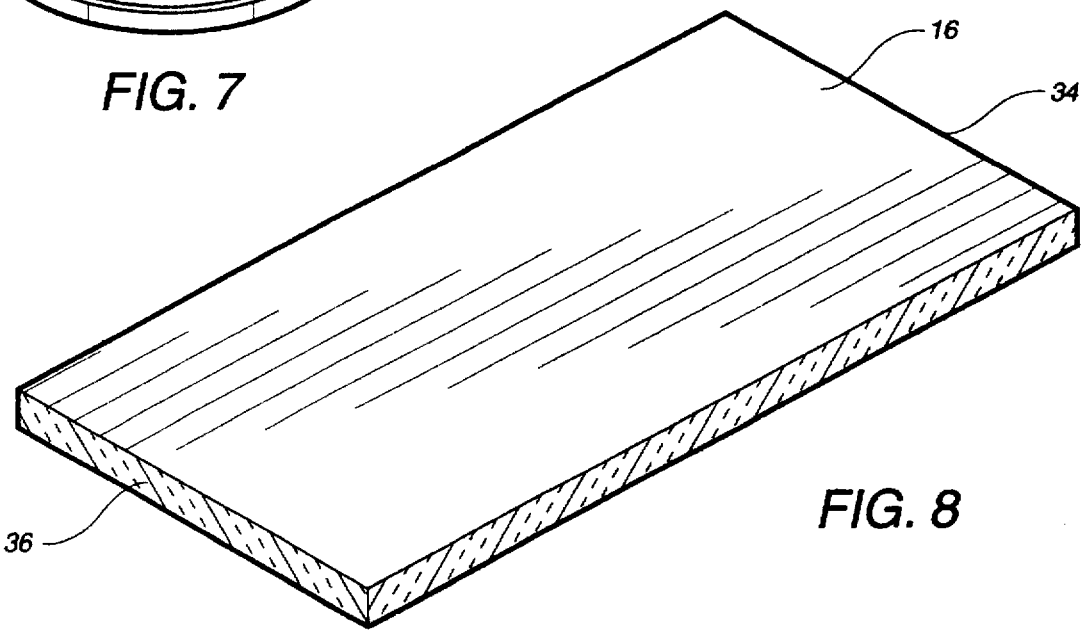
FIG. 8 is a perspective view of the unassembled foam member of the present invention.

FIG. 8 shows the foam member 16. The foam member 16 has a generally flat configuration with ends 34 and 36. Foam member 16 can be formed of any good insulating foam material.

Figure 9A:
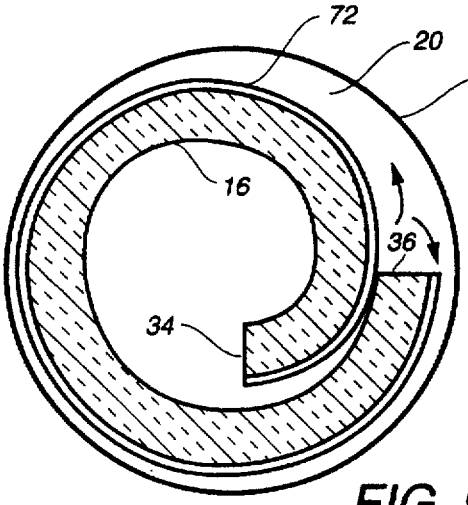
FIGS. 9A–9C show the assembly of the foam member of FIG. 8 within the sleeve of FIG. 6.
Figure 9B:
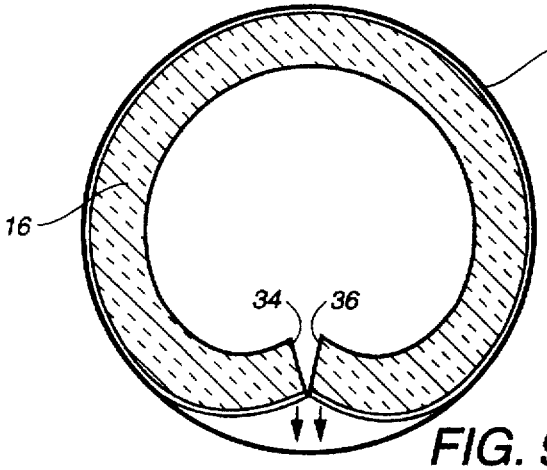
Figure 9C:
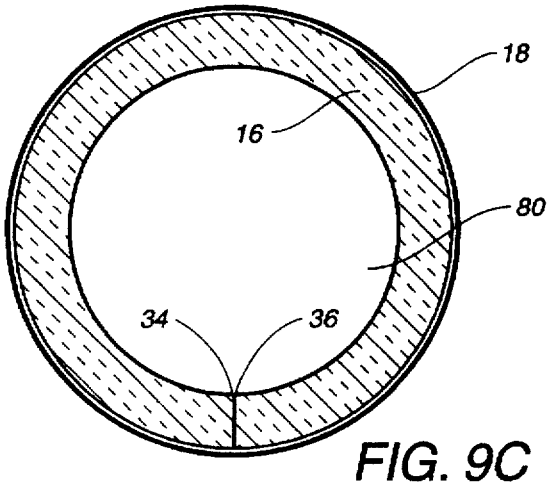

FIGS. 9A–9C show the manner in which the foam member 16 is inserted within the interior of the sleeve 18. Initially, in FIG. 9A, it can be seen that the foam member 16 is curled up so as to fit into the interior 70 of the sleeve 18. In FIG. 9A, image information sheet 72 is affixed to the exterior of the foam member 16. Image information 72 can take the form of a painting, a photograph, a logo, a design, or other desirable information. The image information 72 can be directly affixed to the exterior of the foam member 16 or can be simply inserted between the foam member 16 and the interior of the sleeve 18.

FIG. 9B shows the foam member 16 arranged so that the ends 34 and 36 are placed into close abutment. The exterior of the foam member 16 will generally reside against the inner surface of the sleeve 18. Finally, in FIG. 9C, it can be seen that the foam member 16 is properly positioned within the sleeve 18 such that the ends 34 and 36 are in abutment. The interior area 80 is suitable so as to allow for the insertion of the interior tubular member 26 of the receptacle member 14.

Figure 10:
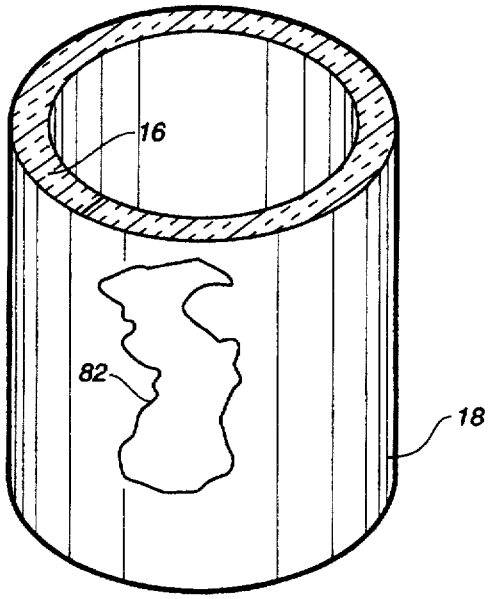
FIG. 10 is a perspective view showing the assembled arrangement of the foam member within the sleeve.

FIG. 10 shows the sleeve 18 as extending around the foam member 16. Image information 82 can be seen through the clear sleeve 18 such that the image information 82 is prominently displayed outwardly of the beverage container insulator apparatus 10 of the present invention.

Importantly, in the present invention, image information 82 can take the form of a photograph which is simply placed between the clear sleeve 18 and the exterior of the foam member 16. As such, the beverage container insulator apparatus of the present invention is able to display graphic information in a clear and more definitive manner than prior techniques of silk screening image information onto the exterior of the beverage container insulator. Complex images can be displayed in a very easy, inexpensive, and efficient manner.

Figure 12:
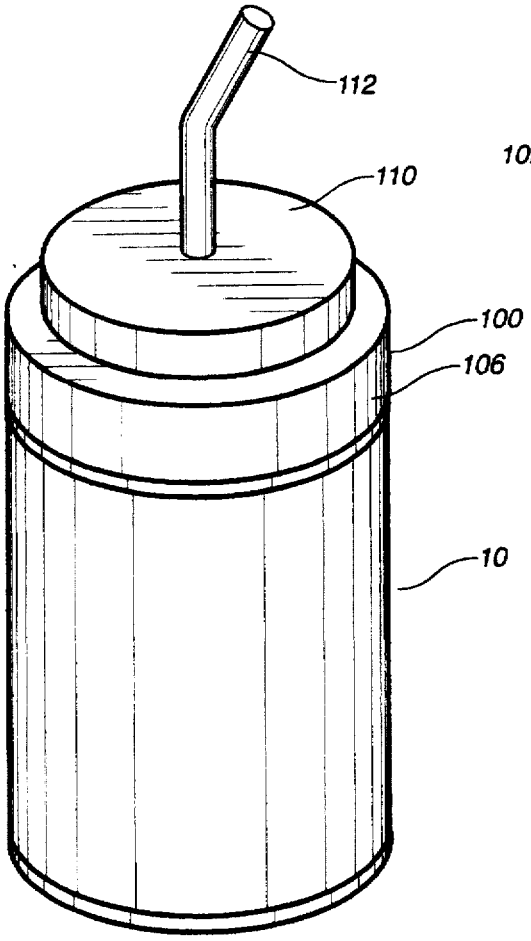
FIG. 12 is an exploded view showing the sports bottle as received within the beverage container insulator apparatus of the present invention.

FIG. 12 shows the manner in which the beverage container insulator 10 of the present invention can be used in association with a sports bottle 100. The sports bottle 100 has a tubular bottom portion 102 with a closed bottom 104. A cylindrical portion 106 extends radially outwardly from the tubular bottom portion 102. An abutment shoulder 108 is formed on the bottom of this cylindrical portion 106. The abutment surface 108 will reside in contact with the flat annular surface 22 of the beverage container insulator apparatus 10. The tubular member 102 will fit into the tubular interior 24. A cap 110 is formed on the top of the sports bottle 100. A straw 112 will extend outwardly of cap 110.

Figure 11:
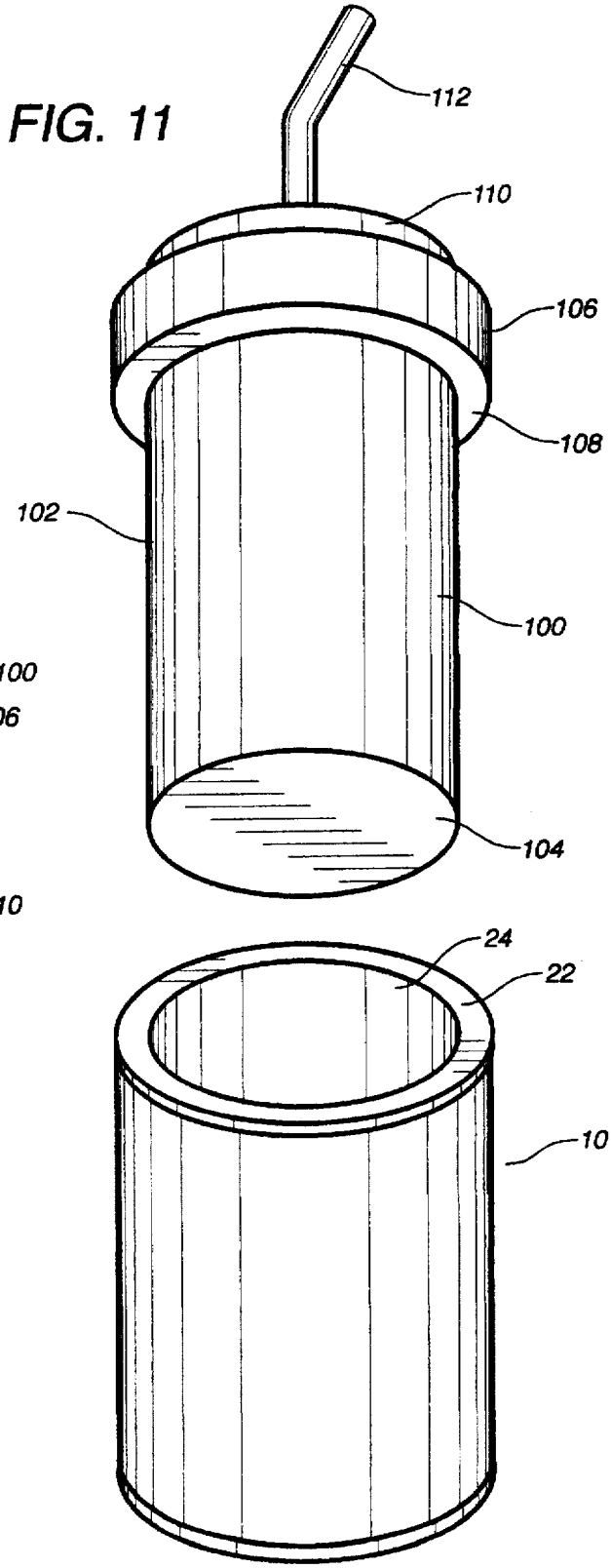
FIG. 11 shows the present invention as receiving a sports bottle therein.

FIG. 11 shows how the sports bottle 100 is received within the beverage container insulator apparatus 10 of the present invention. Importantly, the cylindrical portion 106 has its bottom surface 108 in abutment with the top surface 22 of the insulator 10. The clip will suitably retain the tubular portion 102 within the tubular interior 24. The cap 110 and the straw 112 extend outwardly from the sports bottle 100.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A beverage container insulator apparatus comprising:

a base member having a generally flat surface forming a base of the insulator apparatus and an upwardly extending inner ring member;

a receptacle member having a generally tubular interior, said receptacle member having means thereon for affixing to said base member said inner ring member having a connector receiving said means for affixing, said connector comprising a lip extending around an outer surface of said inner ring member adjacent a top edge of said inner ring member, said means for affixing comprising a ledge extending inwardly from a bottom of said tubular interior of said receptacle member, said lip engaging said ledge so as to retain said base member on a bottom of said receptacle member; and a foam member extending around an exterior surface of said receptacle member.

2. The apparatus of claim 1, said upwardly extending inner ring member having a diameter generally matching an inner diameter of said receptacle member.

3. The apparatus of claim 1, said base member further comprising:

an outer ring member extending upwardly around a periphery of said base member, said foam member being interposed between said inner ring member and said outer ring member.

4. The apparatus of claim 3, further comprising:

a transparent sleeve extending around an exterior of said foam member; and an image member interposed between said sleeve and an exterior of said foam member, said sleeve and said image member being received between said inner ring member and said outer ring member of said base member.

5. The apparatus of claim 3, said inner ring member being concentric with said outer ring member, said inner and outer ring members extending upwardly transversely to said flat surface.

6. The apparatus of claim 1, said receptacle member comprising:

a flat annular surface connected to said tubular interior and extending radially outwardly therefrom, said tubular interior forming a beverage container receiving volume.

7. The apparatus of claim 6, said flat annular surface having a downwardly extending ring member formed along an outer edge of said flat annular surface, said foam member being interposed between said downwardly extending ring member and said exterior surface of said receptacle member.

8. The apparatus of claim 6, said flat annular surface and said tubular interior being integrally formed of a polymeric material.

9. The apparatus of claim 6, said foam member extending entirely around said tubular interior and interposed between said base member and said flat annular surface.

10. The apparatus of claim 6, further comprising:

a transparent sleeve extending around an exterior of said foam member; and an image member interposed between said sleeve and an exterior of said foam member, said transparent sleeve and said image member being positioned between said flat annular surface and said base member.

11. A beverage container insulator apparatus comprising:

a base member;

a receptacle member having a generally tubular interior, said receptacle member having means thereon for affixing to said base member, said receptacle member having a clip member formed in said tubular interior so as to extend resiliently into said tubular interior, said clip member adapted for releasably retaining a beverage container therein; and a foam member extending around an exterior surface of said receptacle member.

12. The apparatus of claim 11, said clip member comprising:

a first clip member;

a second clip member extending into said tubular interior approximately 120° from said first clip member; and a third clip member extending into said tubular interior approximately 120° from said first and second clip members.

13. The apparatus of claim 12, each of said first, second and third clip members having an abutment surface formed thereon, said abutment surface for contacting the beverage container and retaining the beverage container.

14. The apparatus of claim 12, each of said first, second and third clip members comprising:

a generally rectangular surface separate on three sides from said tubular interior; and an abutment surface formed on an inner surface of said rectangular surface, said abutment surface tapering outwardly along said rectangular surface, said abutment surface extending further into said tubular interior at a bottom of said rectangular surface.

15. A beverage container insulator apparatus comprising:

a base member;

a receptacle member having a generally tubular interior, said receptacle member having means thereon for affixing to said base member;

a foam member extending around an exterior surface of said receptacle member;

an openended sleeve extending around an exterior of said foam member, said sleeve being formed of a flexible transparent material; and an image sheet interposed between said sleeve and an exterior of said foam member, said image sheet containing image information formed on a surface facing said sleeve.

16. The apparatus of claim 15, said foam member being a flat member formed into a tubular configuration such that opposing ends of said flat member abut each other when said foam member is retained within said sleeve member.

* * * * *